US008739980B2

(12) United States Patent
Valiulis

(10) Patent No.: US 8,739,980 B2
(45) Date of Patent: Jun. 3, 2014

(54) PUSHER HOOK WITH LIMITED STROKE

(75) Inventor: Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 4 days.

(21) Appl. No.: 13/179,322

(22) Filed: Jul. 8, 2011

(65) Prior Publication Data

US 2013/0008863 A1 Jan. 10, 2013

(51) Int. Cl.
*A47F 5/08* (2006.01)

(52) U.S. Cl.
USPC ..... 211/54.1

(58) Field of Classification Search
CPC ..... A47F 5/0869; A47F 5/0823; A47F 1/128
USPC ..... 211/57.1, 59.7, 54.1, 59.3, 51, 7
See application file for complete search history.

(56) References Cited

U.S. PATENT DOCUMENTS

| | | | | | |
|---|---|---|---|---|---|
| 4,475,658 | A * | 10/1984 | Roberts | 211/54.1 |
| 4,742,936 | A * | 5/1988 | Rein | 221/5 |
| 5,114,021 | A * | 5/1992 | Fredrickson | 211/54.1 |
| 5,485,929 | A * | 1/1996 | Danon | 211/57.1 |
| 5,671,851 | A * | 9/1997 | Johnson et al. | 211/51 |
| 5,743,428 | A * | 4/1998 | Rankin, VI | 221/6 |
| 6,131,748 | A * | 10/2000 | Kawasaki et al. | 211/54.1 |
| 6,158,598 | A * | 12/2000 | Josefsson | 211/54.1 |
| 7,566,037 | B2 * | 7/2009 | Vogler | 248/220.31 |
| 8,240,486 | B2 * | 8/2012 | Niederhuefner et al. | 211/51 |
| 2004/0182976 | A1 * | 9/2004 | Valiulis et al. | 248/220.31 |
| 2007/0102377 | A1 * | 5/2007 | Kikuchi et al. | 211/57.1 |
| 2012/0273434 | A1 * | 11/2012 | Niederhuefner et al. | 211/4 |

* cited by examiner

*Primary Examiner* — Darnell Jayne
*Assistant Examiner* — Kimberley S Wright
(74) *Attorney, Agent, or Firm* — Reinhart Boerner Van Deuren P.C.

(57) ABSTRACT

A pusher hook with limited stroke is provided. The pusher hook includes a first and a second hook. A pusher mechanism is mounted on one of the first and second hooks and operable to bias merchandise carried by one of the first and second hooks. A slidable stop is also provided to limit the forward-most travel of a pusher body of the pusher mechanism along the one of the first and second hooks.

20 Claims, 8 Drawing Sheets

PUSHER HOOK WITH LIMITED STROKE

FIELD OF THE INVENTION

This invention generally relates to retail merchandise hooks, and more particularly to retail merchandise hooks incorporating a self-facing mechanism such as a pusher.

BACKGROUND OF THE INVENTION

Retail merchandise hooks are used to carry a variety of merchandise in a variety of retail environments. Essentially, the hook extends from a vertical retail support wall or structure in a cantilevered fashion. Merchandise is hung from the hook for later removal by a customer.

In recent years, self-facing technology such as pusher systems have increasingly been incorporated into various retail displays. The retail merchandise hook is no exception. A retail merchandise hook incorporating a pusher system is typically referred to as a pusher hook. One example of a contemporary pusher hook is generally illustrated at FIG. 1.

As illustrated at FIG. 1, the pusher hook 20 is mounted to a retail merchandise wall 22 such as a peg board, slatwall, or other similar or dissimilar mounting system. The pusher hook 20 includes a first hook 24 and a second hook 26 extending from the wall 22 in a cantilevered fashion and parallel to one another.

The first hook 24 carries merchandise 28 thereon as illustrated. A pusher mechanism 30 is mounted to the second hook 26. The pusher mechanism 30 is responsible for biasing the merchandise 28 forward in direction 44 on the first hook 24 until the leading package of merchandise 28 comes into abutted contact with an upward bend 42 formed at an end of the first hook 24.

The pusher mechanism 30 includes a base 32, a pusher body 34, and a spring 36 extending therebetween. The base 32 is mounted at a leading end of the second hook 26 and carries the remainder of the spring 36 therein. The pusher body 34 is slidable along the second hook 26 and is biased in direction 44 under the action of the spring 36. The biasing action provided by the spring 36 is strong enough to slide merchandise 28 forward along the first hook 24 and into engagement with the upward bend 42 thereof, but not so strong as to bias merchandise 28 completely off the first hook 24.

Due to the location of the housing 32, the pusher body 34 will continue to move in direction 44 along the second hook 26 under the biasing action of the spring until all merchandise is removed, and the pusher body is in abutted contact with the upward bend 42 of the first hook 24. Put differently, the location of the housing 32 at the end of the second hook 26 is such that the biasing force provided by the spring is transferred to the pusher body 34 along a large extent, if not all, of the length of the first hook 24 until the pusher body comes into contact with the upward bend 42 thereof.

Unfortunately, this constant biasing force along the entire length of the first hook 24 can create a disadvantageous and unappealing forward lean in the merchandise 28 generally in direction 46 as illustrated. This forward lean arises because once the leading item of merchandise 28 abuts the upward bend 42, a biasing force is still provided by the pusher body 34 on the row of merchandise 28. Such a configuration causes all of the merchandise, or at least the first few items in the row, to lean outward and rotate generally in direction 46 about their respective mounting points upon the first hook 24.

The aforementioned outward lean can result in items falling off the hook, damage to packaging, and an aesthetically displeasing look. Accordingly, there is a need in the art for a pusher hook that does not create the aforementioned forward lean.

The invention provides such a pusher hook. These and other advantages of the invention, as well as additional inventive features, will be apparent from the description of the invention provided herein.

BRIEF SUMMARY OF THE INVENTION

In one aspect, embodiments of the invention provide a pusher hook that is mountable upon a retail merchandise wall and configured to carry and bias retail merchandise. The pusher hook includes a first hook and a second hook. A pusher mechanism is mounted on one of the first and second hooks. The pusher mechanism is operable to bias retail merchandise carried by one of the first and second hooks forward and towards an end thereof. The pusher hook also includes a stop mounted on one of the first and second hooks. The stop is spaced apart from an end of the hook that it is mounted upon. The stop is operable to limit the forward travel of a pusher body of the pusher mechanism mounted on the one of the first and second hooks.

In certain embodiments, the pusher mechanism is mounted on the second hook above the first hook and includes a housing spaced apart from the pusher body. The housing carries a coil spring that has an uncoiled portion extending from the housing with a free end thereof connected to the pusher body. The stop is formed on the housing such that the pusher body abuts the stop away from the end of the second hook.

In certain embodiments, the stop is formed by an abutment surface of a rear wall of the housing. The rear wall and a pair of opposed side walls define a chamber for receipt of a coiled portion of the coil spring.

In certain embodiments, the pusher body includes a connector portion that slideably mounts the pusher body to one of the first and second hooks. Forward travel of the pusher body is limited by abutment of the connector portion with the abutment surface of the housing.

In certain embodiments, the pusher mechanism is mounted on the second hook above the first hook. The pusher mechanism includes a housing spaced apart from the pusher body. The housing carries a coil spring that has an uncoiled portion extending from the housing with a free end thereof connected to the pusher body. The stop is mounted on the second hook between the housing and the pusher body.

In certain embodiments, the stop is a ring shaped collar and is slidable along the second hook relative to the pusher body and relative to the housing. In certain embodiments, the stop includes a lock for fixing a position of the stop along the second hook. The position defines a maximum forward point of travel of the pusher body.

In certain embodiments, the pusher body is slideably mounted on the second hook. The first hook is below the second hook and is configured to carry merchandise thereon. The pusher body includes a slot therethrough for passage of the first hook.

In certain embodiments, the pusher mechanism includes a housing. The housing carries a coil spring having an uncoiled portion with a free end. The free end is connected to the pusher body. Retraction of the pusher body along the second hook and away from the housing uncoils the coil spring from the housing.

In certain embodiments, the housing includes a connector portion. The connector portion provides a resilient snap connection of the housing to the second hook. In certain embodiments, the connector portion includes a pair of resilient tabs in opposed spaced relation with a gap formed therebetween. The second hook is received within the gap. The gap is sized to substantially limit free sliding movement of the housing along the second hook.

In certain embodiments, the connector portion includes a lock. The lock is configured to fix the housing at a select location along the second hook.

In another aspect, a retail merchandise display for self-facing retail merchandise is provided. The retail merchandise display includes a generally vertical retail wall. A retail merchandise hook extends from the generally vertical retail wall. A pusher mechanism that has a limited stroke is positioned on the retail merchandise hook. A stop is mounted on the retail merchandise hook and is configured to limit the travel of a pusher body of the pusher mechanism along the retail merchandise hook to less than the entire length of the retail merchandise hook.

In certain embodiments, the stop is operable to selectively define a limit of forward travel of the pusher body along the retail merchandise hook. The limit of forward travel is spaced away from a leading end of the retail merchandise hook.

In certain embodiments, the pusher mechanism includes a housing carrying a coil spring, the coil spring has an uncoiled portion extending away from the housing with a free end thereof mounted to the pusher body. The coil spring is operable to bias the pusher body towards the housing along the retail merchandise hook.

In certain embodiments, the stop is formed on an abutment surface of the housing. The abutment surface arranged on the body to abut the pusher body to limit the forward travel thereof beyond the abutment surface.

In certain embodiments, the stop is a ring-shaped collar slidable on the retail merchandise hook and positioned between the housing and the pusher body. The stop is slidable along the retail merchandise hook relative to the pusher body and relative to the housing. In certain embodiments, the stop prevents forward movement of the pusher body along the retail merchandise hook beyond a stopping point. The stopping point is spaced away from a leading end of the retail merchandise hook by at least about one inch.

In yet another aspect, a method for installing a pusher hook on a generally vertical retail wall is provided. The method comprises mounting a mounting structure of the pusher hook on the generally vertical retail wall such that the pusher hook extends therefrom in a cantilevered fashion. The method also includes adjusting a position of a stop of the pusher hook along a length of the pusher hook to define a forward-most point of travel of a pusher body of the pusher hook along the length of the pusher hook.

In certain embodiments, the method also includes locking the stop in a position such that the forward-most point of travel is spaced apart from a leading end of the pusher hook.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, a pusher hook is shown and described herein that overcomes existing problems in the art. More specifically, the pusher hook incorporates a novel stopping feature that limits the stroke length of a pusher mechanism of the pusher hook. As a result, the aforementioned problems of prior designs with regard to the forward lean (see e.g. FIG. 1) of retail merchandise carried thereon are eliminated.

Figure 2:
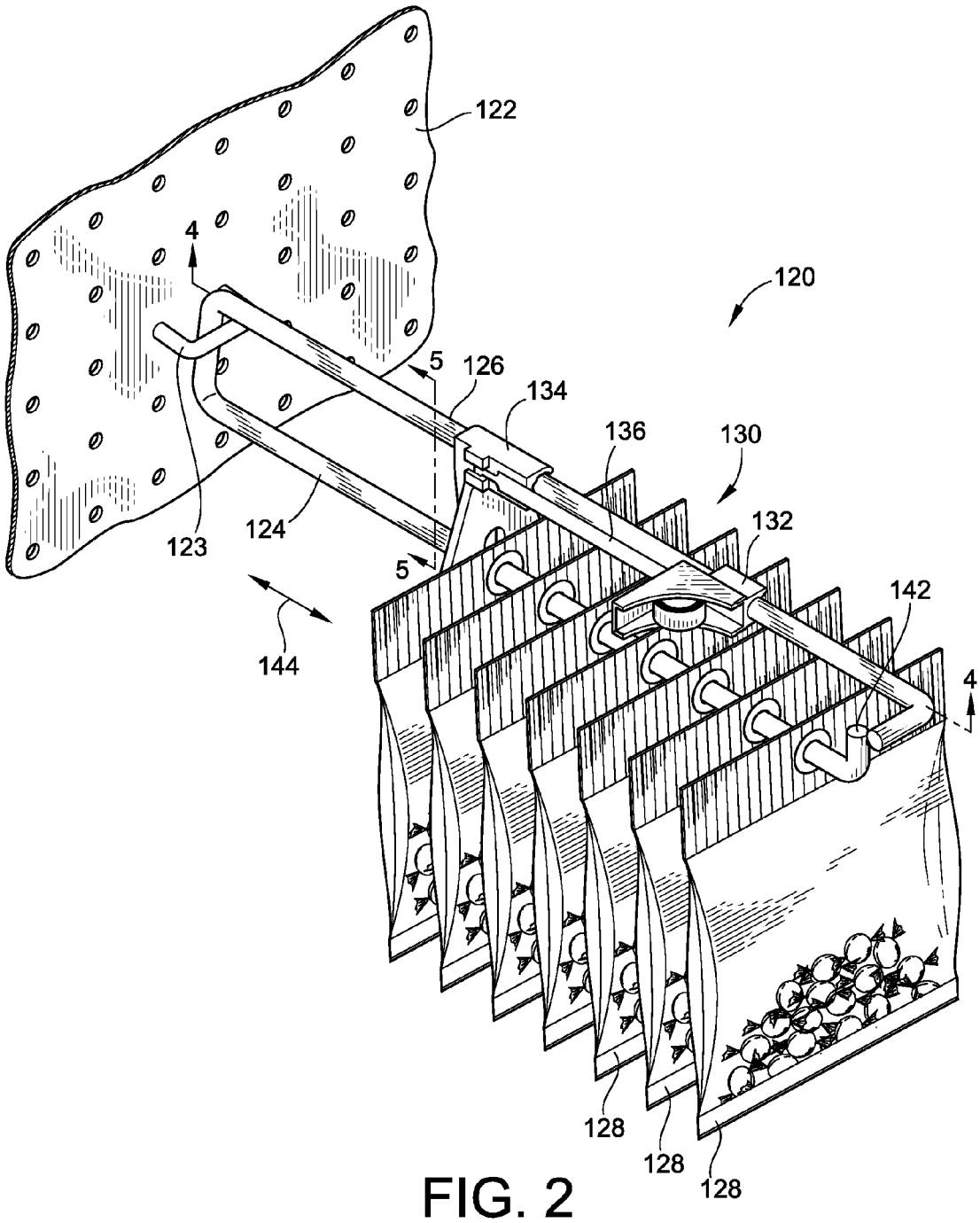
FIG. 2 is a perspective view of a first embodiment of a pusher hook with limited stroke according to the teachings of the present invention mounted on a vertical retail wall and carrying merchandise thereon.

With particular reference to FIG. 2, a first embodiment of a pusher hook 120 is illustrated. The pusher hook 120 is mounted upon a generally vertical retail wall 122. In the illustrated embodiment, the generally vertical retail wall 122 is a pegboard. However, it will be immediately recognized that other vertical retail wall-like structures could be utilized such as for non-limiting example a slat wall.

The pusher hook 120 is mounted on the retail wall 122 by way of a mounting structure 123 of the pusher hook 120. The mounting structure 123 is generally shown, as it will be recognized that various types of mounting geometry could be used depending upon the application of the pusher hook 120. For example, the mounting structure 123 could be embodied as a backing plate used to mount with slat wall structures, or other similar or dissimilar structures.

The pusher hook 120 includes a first hook 124 and a second hook 126 positioned above the first hook 124. Retail merchandise 128 is carried on the first hook 124. A pusher mechanism 130 is mounted on the second hook 126 and is operable to bias the retail merchandise 128 towards a leading end of the first hook 124.

The pusher mechanism 130 includes a housing 132 and a pusher body 134. A coil spring 136 is carried by the housing 132. An uncoiled portion of the coil spring 136 extends from the housing 132 and has a free end that is connected to the pusher body 134. The housing 132 is fixedly attached to the second hook 126, while the pusher body 134 is free to slide along the second hook 126 under the biasing force provided by the coil spring 136, and particularly due to its tendency to coil back into the housing 132.

The first hook 124 includes an upward bend 142 formed at an end thereof. The pusher body 134 is slidable along the second hook 126 in a direction that is parallel to direction 144 as illustrated. As the pusher body 134 moves forward along the second hook 126 it also biases or pushes the retail merchandise 128 forward until the leading item of retail merchandise 128 comes into contact with, or is in proximity to, the upward bend 142. However, the pusher hook 100 also includes a stopping feature that limits the overall maximum forward point of travel of the pusher body 134 so as to prevent an unnecessary amount of biasing force placed against the row of retail merchandise 128 that would otherwise cause the aforementioned undesirable forward lean of the leading items of retail merchandise 128.

Figure 3:
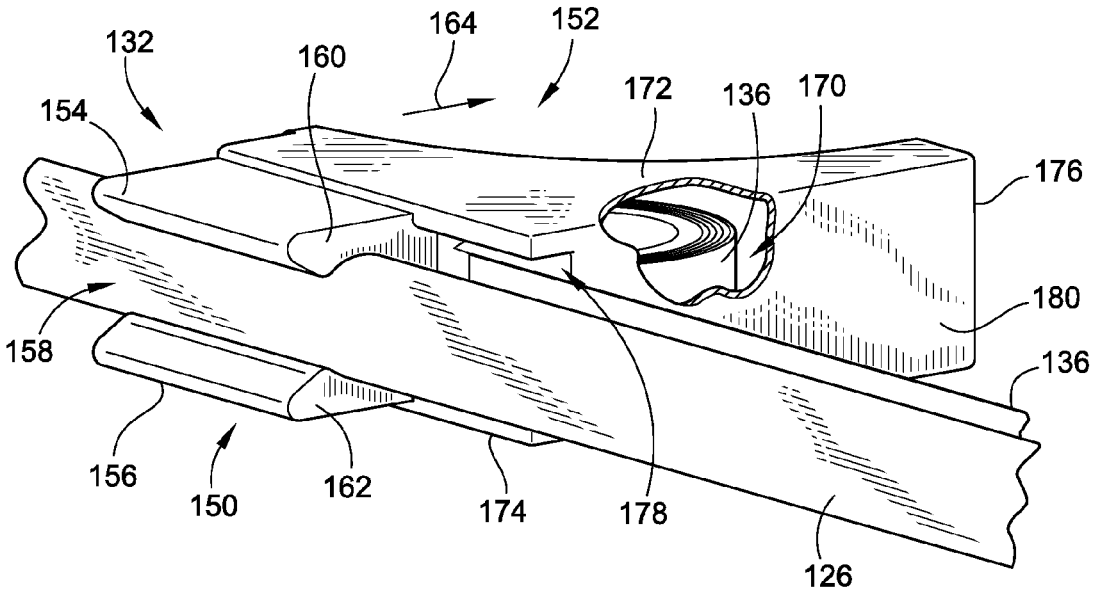
FIG. 3 is a perspective view of a housing of the pusher hook of FIG. 2.
Figure 4:
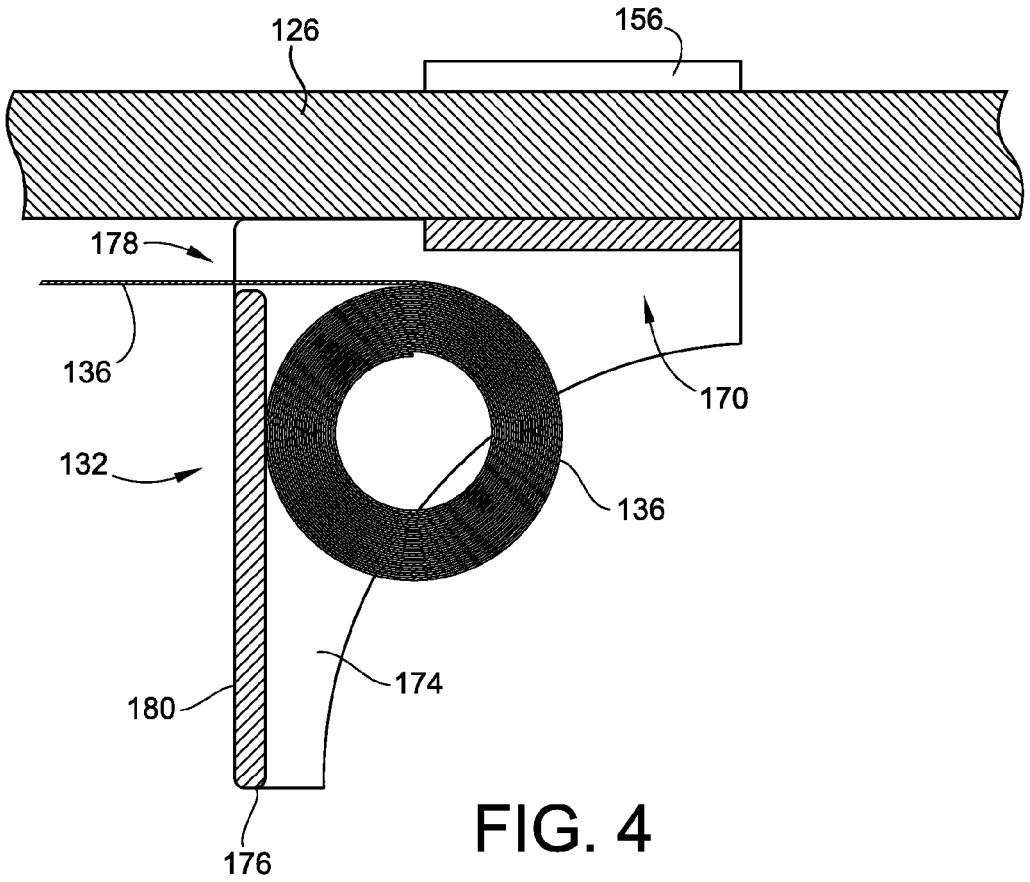
FIG. 4 is a top cross sectional view of the housing of FIG. 3.

Turning now to FIGS. 3 and 4 the structural features of the housing 132 will be described in greater detail. With particular reference to FIG. 3, the housing 132 includes a connector portion 150 and a spring retainer portion 152. The connector portion 150 is used to mount the housing 132 to the second hook 126. More specifically, the connector portion 150 includes a pair of resilient tabs 154, 156 with a gap 158 formed therebetween. The gap 158 is sized to receive the second hook 126 such that the free sliding movement of the housing 132 relative to the second hook 126 is substantially reduced or prevented. By "free sliding movement" it is meant that the resilient tabs 154, 156 and gap 158 are sized such that once the housing 132 is snappedly connected to the second hook 126, it will not freely slide as a result of the operation of the pusher mechanism 130 (see FIG. 1), but instead must be adjusted with a sufficient amount of force either by hand or by a tool.

Each of the resilient tabs 154, 156 includes an enlarged section 160, 162, respectively. The enlarged sections 160, 162 generally prevent the housing 132 from moving in a direction 164 relative to the second hook 126 once snappedly connected thereto. Additionally, the connector portion 150 can also include a locking feature or mechanism such as a set screw or a cam lock generally recognized in the art to axially position the housing 132 along the second hook 126. Indeed, while the tabs 154, 156 and gap 158 therebetween generally function as a lock or locking feature as described above, other types of mechanical locks could also be incorporated into the connector portion 150.

The spring retainer portion 152 includes a chamber 170 for receipt of a coiled portion of the coil spring 136. The chamber 170 is bounded by a pair of side walls 172, 174 and a rear wall 176 positioned between the pair of side walls 172, 174. An opening 178 is formed in the rear wall 176 to allow the uncoiled portion of the coil spring 136 to extend out of the housing 132 as the pusher body (see FIG. 2) is drawn away from the housing 132 along the second hook 126.

With reference now to FIG. 4, as the spring 136 is uncoiled from the housing 132 through the opening 178, the remaining coiled portion of the spring 136 will generally seat against the rear wall 176. The rear wall 176 also defines an abutment surface 180. The abutment surface 180 functions as the aforementioned stopping feature as will be described in greater detail below.

Figure 5:
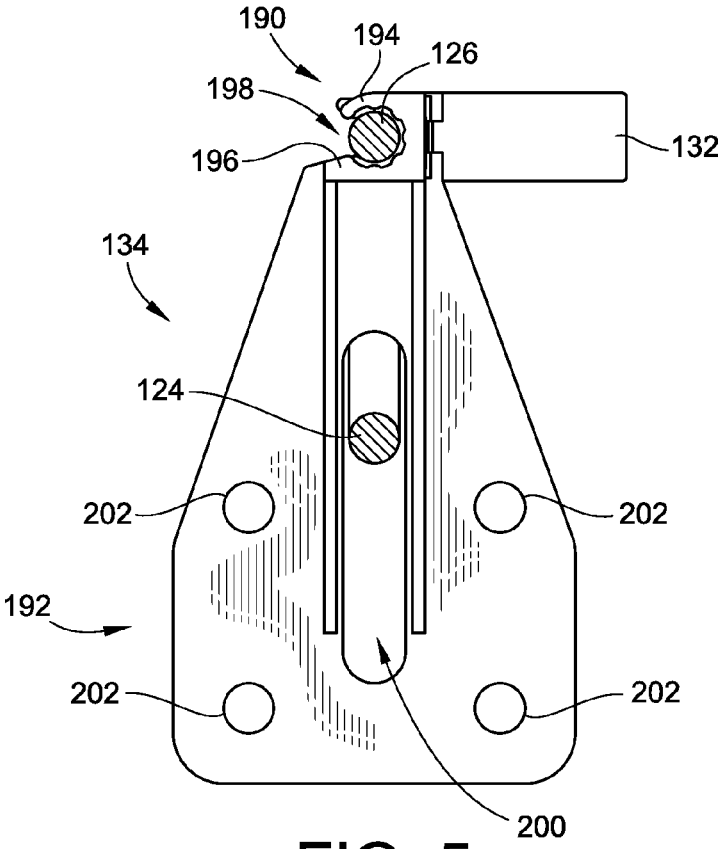
FIG. 5 is a back view of a pusher body of the pusher hook of FIG. 2.
Figure 6:
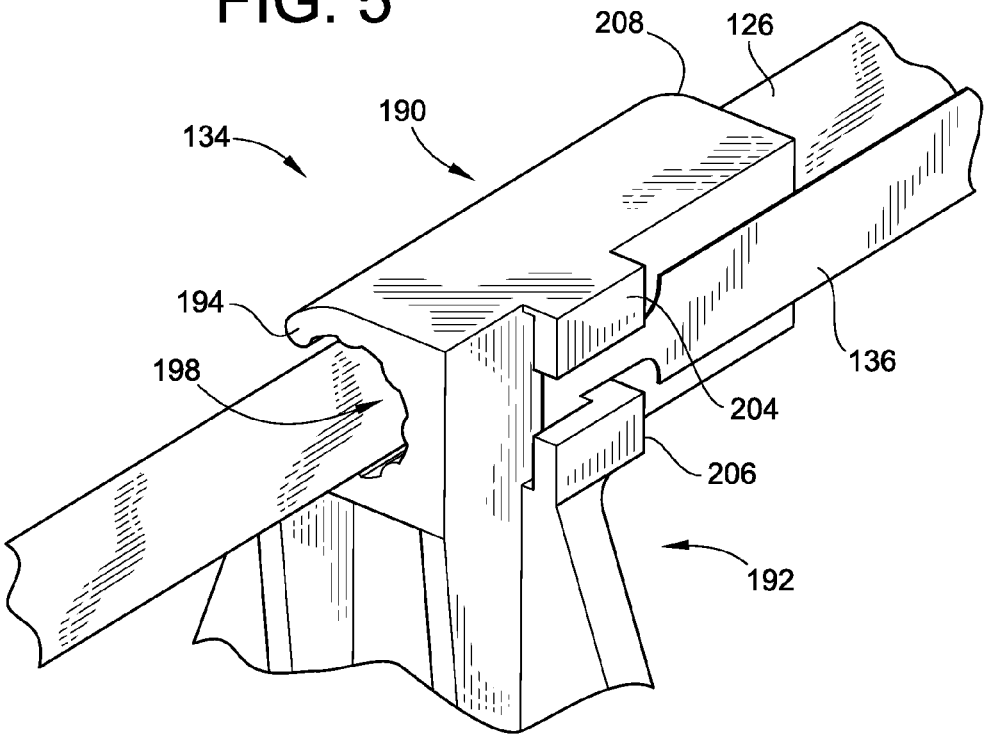
FIG. 6 is a perspective view of a connector portion of the pusher body of FIG. 5.

Turning now to FIGS. 5 and 6, the structural features of the pusher body 134 will be described in greater detail. With particular reference to FIG. 5, the pusher body 134 includes a connector portion 190 and a paddle portion 192. In a similar configuration as the connector portion 150 (see FIG. 3) of the housing 132, the connector portion 190 of the pusher body 134 also includes a pair of resilient tabs 194, 196 with a gap 198 formed therebetween. The resilient tabs 194, 196 and gap 198 are sized such that the second hook 126 is received therein and the pusher body 134 is freely slidable therealong. The paddle portion 192 includes a slot 200 that allows the passage of the first hook 124 through the paddle portion 192 as the pusher body 134 is slid along the second hook 126. Also shown in FIG. 5, the paddle portion 192 can include a plurality of mounting features such as apertures 202 for connection of pusher extender plates and the like commonly known in the art.

Turning now to FIG. 6, the free end of the coil spring 136 has a generally T-shaped profile that is held in place by retainers 204, 206 formed on the connector portion 190. The retainers 204, 206 hold the free end of the coil spring 136 as the pusher is drawn away from the housing 132 (see FIG. 2) and as the pusher body 134 moves towards the housing 132.

Figure 1:
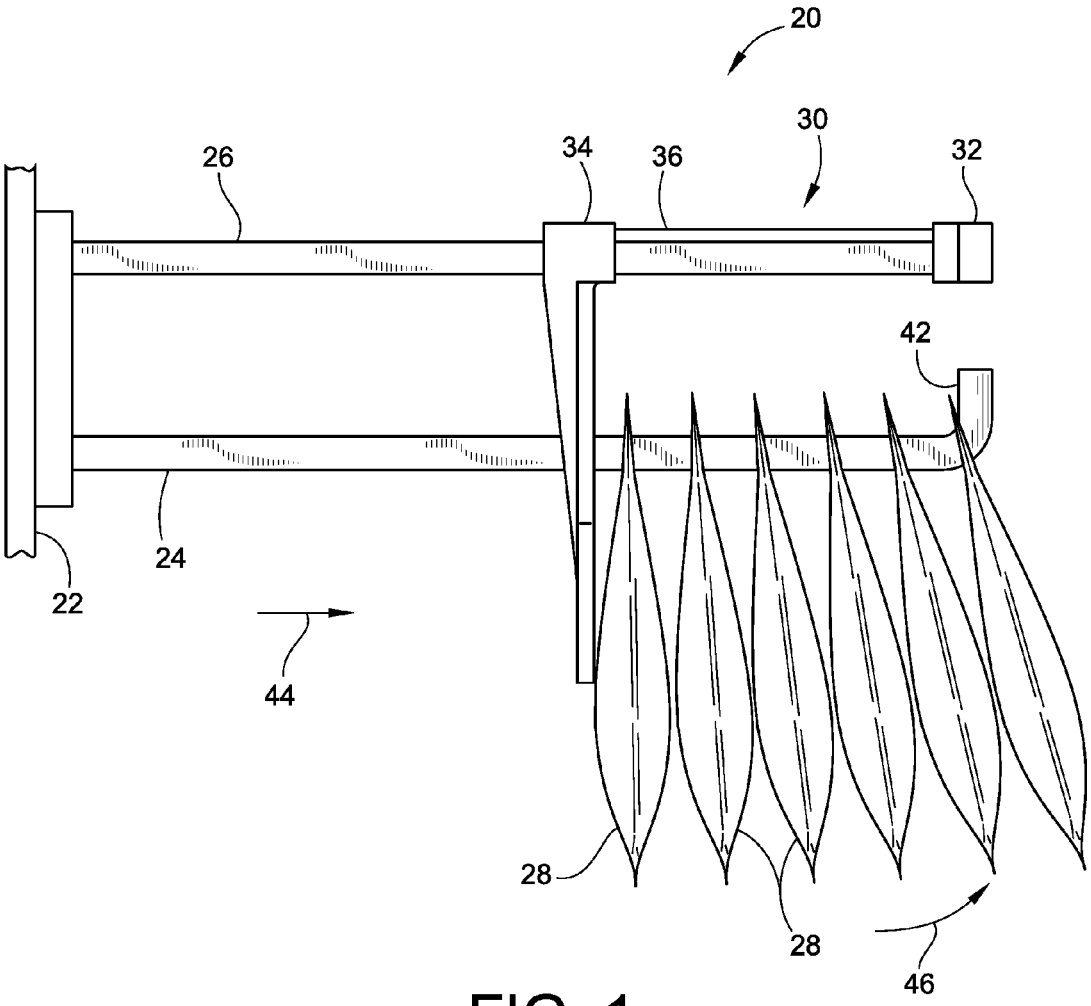
FIG. 1 PRIOR ART
FIG. 1 is a side view illustration of a conventional pusher hook known in the art.
Figure 7:
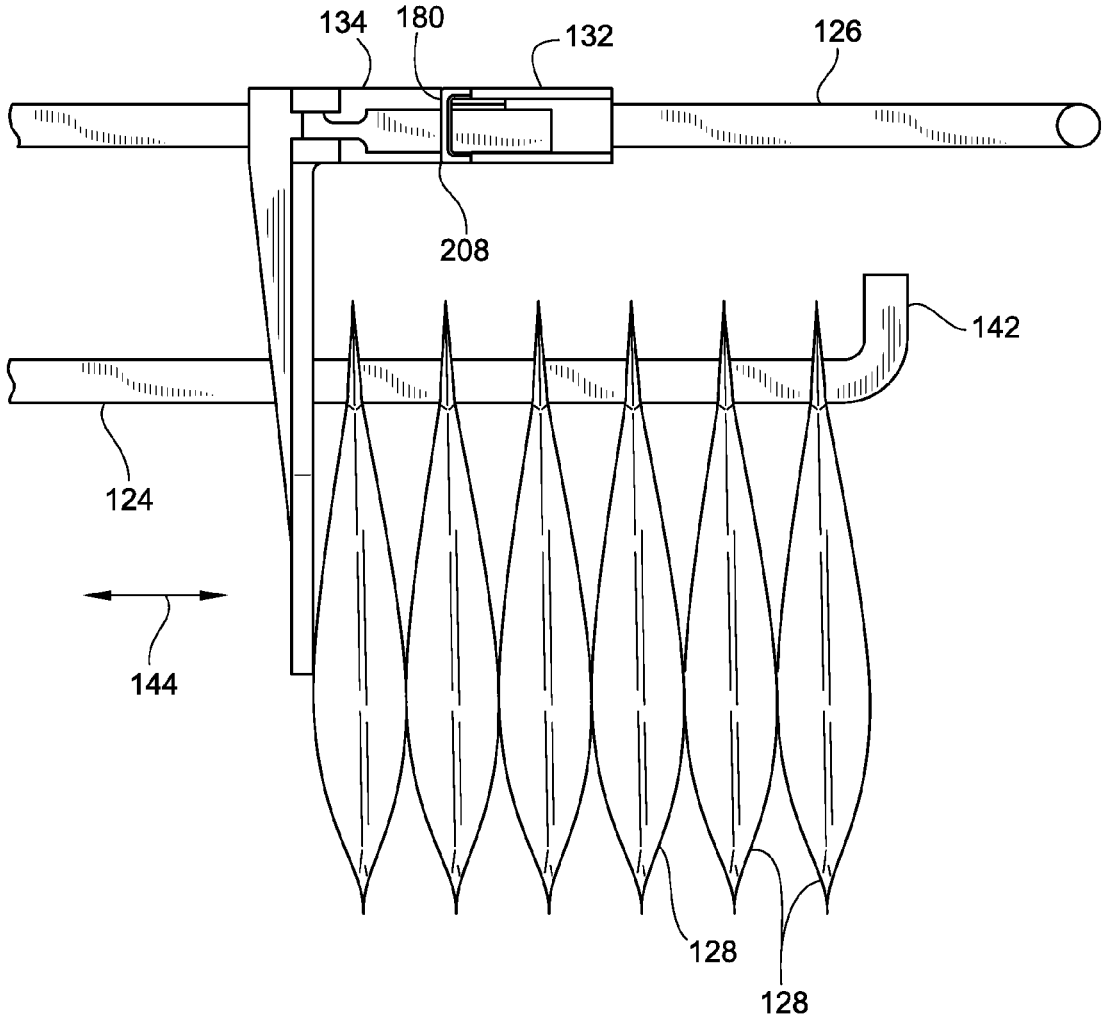
FIG. 7 is a side view of the pusher hook of FIG. 2.

Turning now to FIG. 7, the pusher body 134, and more specifically the connector portion 190 (see FIG. 6), defines a leading edge 208. The leading edge 208 is the forward-most portion of the pusher body 134. As such, the leading edge 208 will contact the abutment surface 180 of the housing 132 and further forward movement of the pusher body 134 along the second hook 126 is thus prevented. This configuration is generally illustrated at FIG. 7. As a result, a continuous biasing force is not placed against the row of retail merchandise 128 beyond the forward most point of travel of the pusher body 134 defined by the abutment of the leading edge 208 with the abutment surface 180, and the undesirable forward lean as shown at FIG. 1 present in prior designs is reduced or eliminated.

The axial position of the housing 132 along the second hook 126 will generally define the maximum forward-most point of travel of the pusher body 134 by way of the aforementioned abutment between the abutment surface 180 and the leading edge 208. A user can adjust the position of the housing 132 by sliding it by hand or using a tool along the second hook 126. Such adjustment allows the pusher mechanism 130 (see FIG. 2) to accommodate various merchandise sizes.

That is, on heavier items, there is less of a tendency for the row of merchandise 128 to have a pronounced forward lean upon continued biasing by the pusher body 134. As a result, the housing 132 can be slid closer to the end of the second hook 126. For lighter items, the converse is true.

More specifically, the housing 132 may be slid farther away from the leading end of the second hook 126 to position the maximum forward-most point of travel of the pusher body 134 farther away then where it would be for heavier items.

In one preferred embodiment, the housing 132 is slidable along the entire length of the second hook 126 such that the stopping point or forward-most point of travel of the pusher body 134 is between about one-half inches to about six inches from the leading end of the second hook 126. In an even more preferred embodiment, the maximum forward-most point of travel of the pusher body 134 is between about one inch and about four inches from the leading end of the second hook 126. In an even more preferred embodiment, the forward-most point of travel of the pusher body 134 is between about one and one inch and about two inches from the leading end of the second hook 126.

Despite these generally preferred locations, the particular location of the housing 132 that will define the maximum forward-most point of travel of the pusher body 134 is largely dependent upon the weight of the retail merchandise 128 carried by the first hook 124. However, other parameters also are important such as the geometry of packaging of the retail merchandise 128, and the resistance of the packaging to slide along the first hook 124 as it is carried thereon. FIGS. 8-11 illustrate a second embodiment of a pusher hook 220. Many of the features of this second embodiment of a pusher hook 220 are similar or identical to those of the first embodiment of the pusher hook 120 described above. As such, only the differences between these two embodiments will be described.

Figure 8:
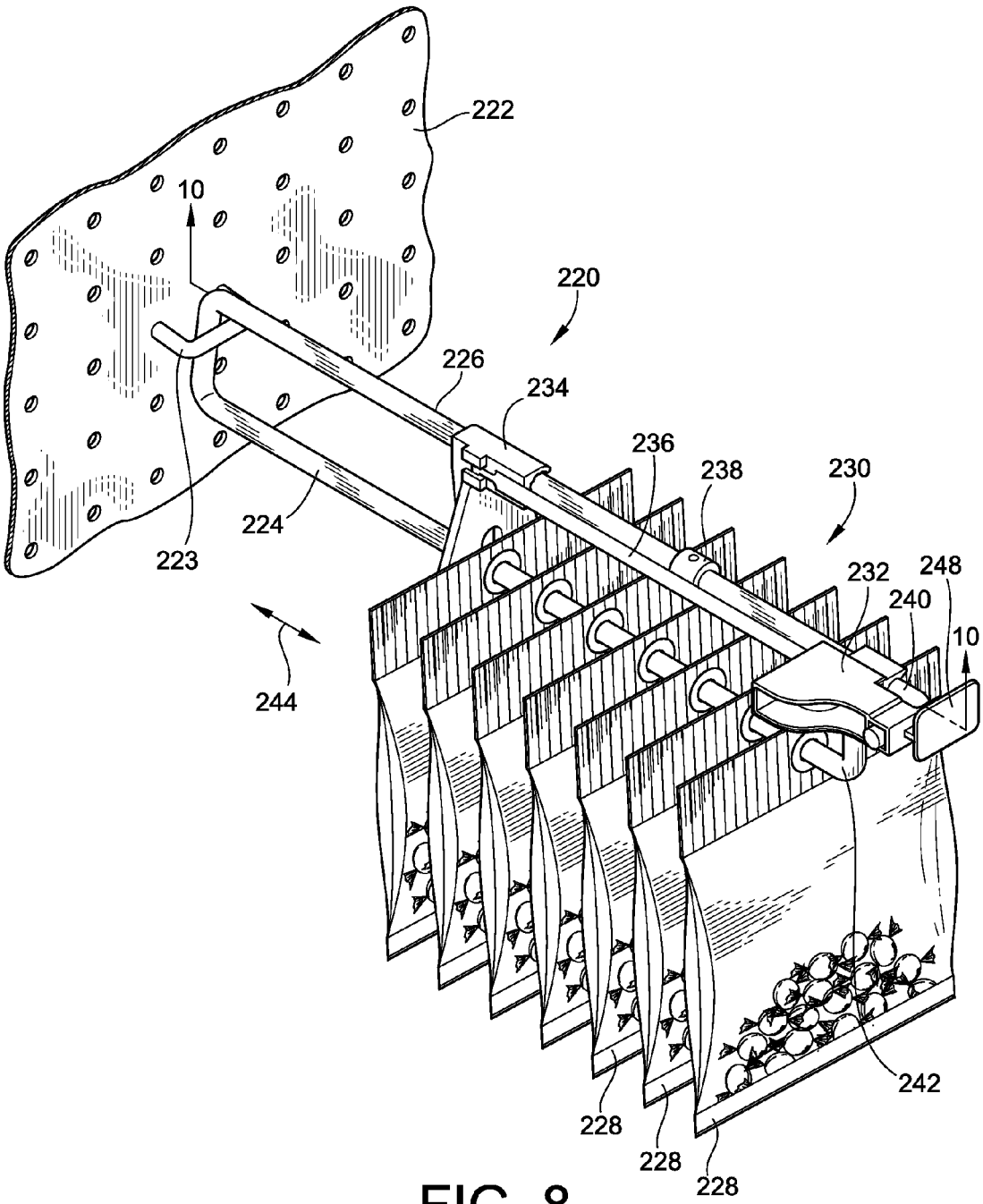
FIG. 8 is a perspective view of a second embodiment of a pusher hook with limited stroke according to the teachings of the present invention mounted on a vertical retail wall and carrying merchandise thereon.

With particular reference to FIG. 8, the pusher hook 220 is mounted to a generally vertical retail wall 222 via a mounting structure 223 of the pusher hook 200. Similar to the first embodiment, the vertical retail wall 222 and mounting structure 223 are not limited to the particular configuration shown, but may vary based upon a particular application. For example, a slat wall could also be utilized along with the attendant mounting structures typically associated therewith. The illustrated embodiment of the pusher hook 220 includes a first hook 224 and a second hook 226. The first hook 224 carries merchandise 228 thereon. The second hook 226 carries a pusher mechanism 230.

The pusher mechanism 230 includes a fixed housing 232, a pusher body 234, a spring 236 extending between the housing 232 and pusher body 234, and a stop 238 positioned between the housing 232 and the pusher body 234. Similar to that described above, the coil spring 236 is operable to supply a biasing force to the pusher body 234 to draw it forward towards the housing 232. As this occurs the pusher body 234 will contact the rearmost item of merchandise 228 to bias the row of merchandise 228 in direction 244 and towards an upward bend 242 formed in a leading end of the first hook 224. Unlike the previous embodiment, the stopping feature is not provided by the housing 232. Rather, the housing 232 remains fixed at an end of the second hook 226. Instead, the stop ring 238 is slidable along the second hook and fixedly mountable thereto to define a maximum forward-most point of travel of the pusher 234 as will be described below.

Figure 9:
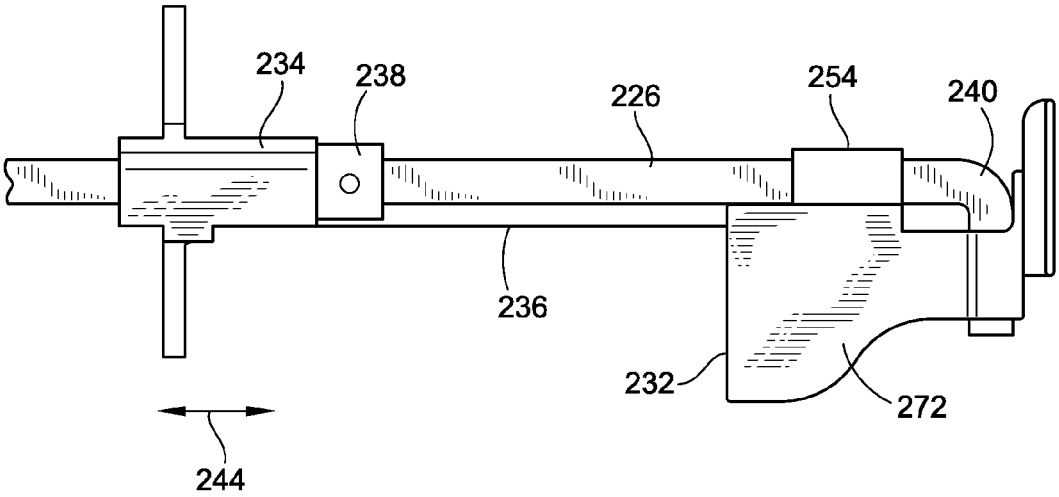
FIG. 9 is a partial top view of the pusher hook of FIG. 8.

Turning now to FIG. 9, the stop ring 238 is slidable relative to the housing 232 and the pusher body 234 along the second hook 226. Once in position, the stop ring 238 may be locked in place by way of a set screw or other locking mechanism commonly recognized in the art. The pusher body 234 will abut the stop ring 238 as it moves forward along direction 244 under the biasing force provided by the coil spring 236. As such, the above described advantages of eliminating the forward lean of the leading most item or items of merchandise carried by the first hook 224 (see FIG. 8) are thus achieved.

Figure 10:
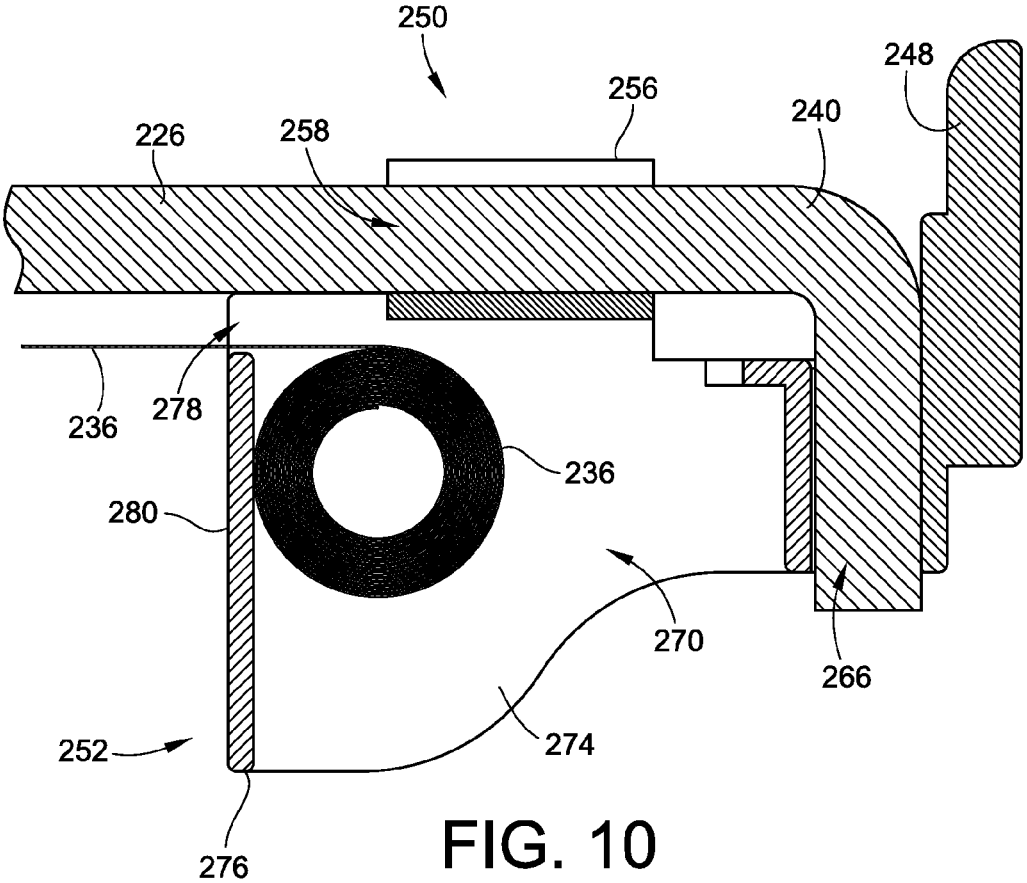
FIG. 10 is a partial top cross sectional view of a housing of the pusher hook of FIG. 8.

With reference now to FIG. 10, the housing 232 also includes a connector portion 250 and spring retainer portion 252. The connector portion 250 snappedly connects to the second hook 226 by way of resilient tabs 254, 256 (see also FIG. 9) such that the second hook 226 is positioned in a gap 258 between the resilient tabs 254, 256. In this embodiment, the leading end of the second hook 226 also includes a generally 90° bend 240. This portion of the second hook 226 is received by a hook retain channel 226 of the housing 232 as illustrated. As such, the housing 232 is generally held in place at an end of the second hook 226. Accordingly, other structures can also be incorporated into the housing 232 that are typically associated with an end of an upper hook of a dual hook design. For example, the housing 232 can incorporate a label holder 248 as illustrated for receipt of labels or other signage.

The spring portion 252 includes a pair of side walls 272, 274 (see also FIG. 9) with a rear wall 276 positioned therebetween. The walls 272, 274, 276 define a chamber 270 for receipt of a coiled portion of the coil spring 236. An opening 278 is formed in the rear wall 276 which allows an uncoiled portion of the coil spring 236 to pass out of the housing 232.

The pusher body 234 (see FIG. 9) is similar or the same as the pusher body described above. As such, the particular features of the pusher body 234 are not redundantly described hereinbelow.

Figure 11:
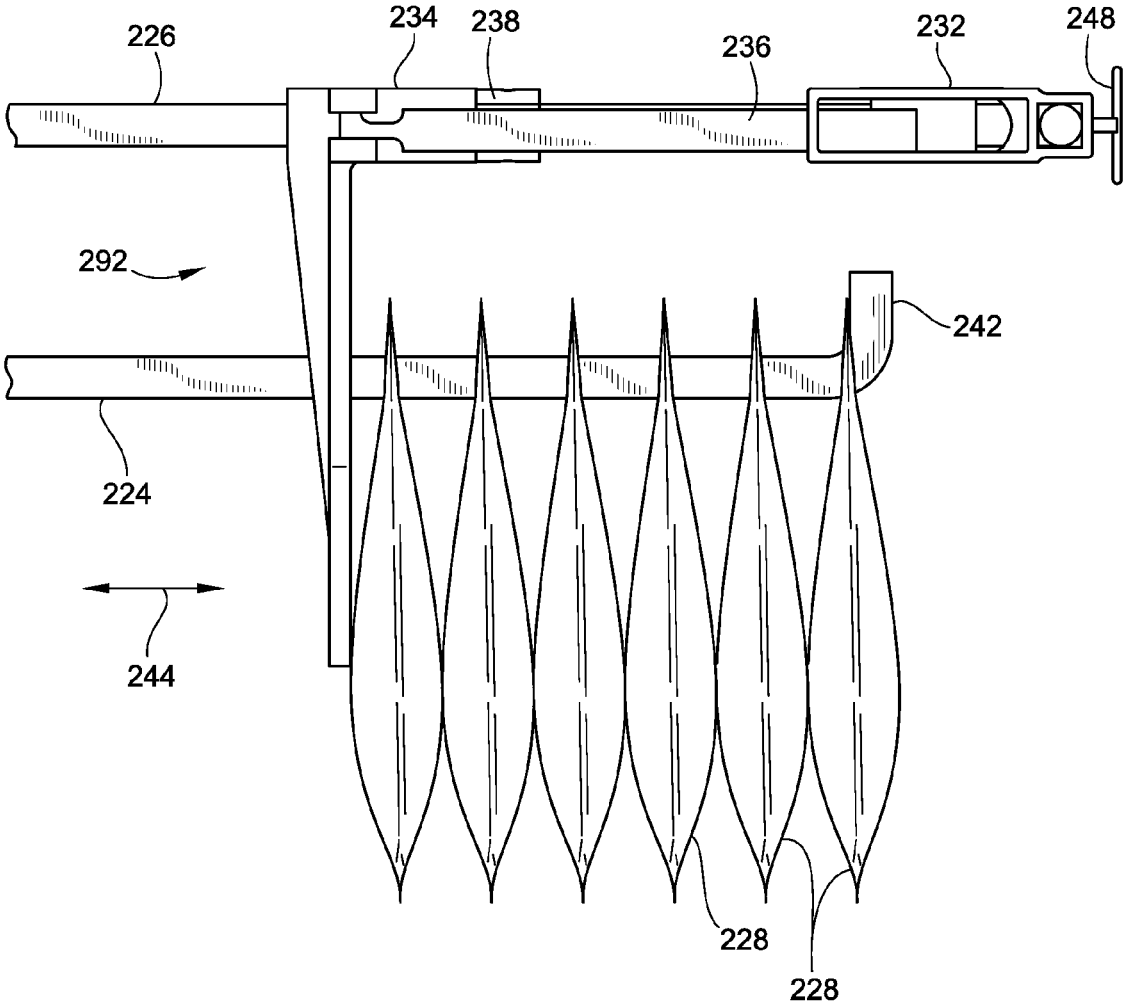
FIG. 11 is a side view of the pusher hook of FIG. 8.

Turning now to FIG. 11, the pusher body 234 is illustrated in abutted contact with the stop ring 238. Similar to the previous embodiment, this abutted contact reduces or eliminates the tendency of the items of retail merchandise 228 to exhibit a forward lean as in prior designs and shown at FIG. 1. Also similar to that described above, the particular location of the stop ring 238 is largely dependent upon the type of merchandise carried by the first hook 224. That is, the weight, size, and packaging geometry will determine at what point along the second hook 226 the stop ring 238 should be positioned to prevent the aforementioned forward lean.

Having described the various structural attributes of several embodiments of the instant invention, a description will now be provided of the method of installation and use of these embodiments. First, the pusher hook 120, 220 is mounted upon a generally vertical retail wall 122, 222. The particular operations involved with this step are largely dependent upon the type of retail wall and the associated mounting structure 123, 223 of the pusher hook 120, 220. Once mounted, the stop of the pusher hook 120, 222 is set at its selected position to reduce or eliminate the aforementioned undesirable forward lean of merchandise 128, 228 carried by the pusher hook 120, 220. In the case of the above-described first embodiment, the housing 132 is slid along the second hook 126 until it is at the desired position. In an embodiment also incorporating a mechanical lock, the housing 132 is locked in position along the second hook 126.

In the second embodiment described above, the step of positioning the stop includes sliding the stop ring 238 along the second hook 226 until it is in the desired position. Once in position, the stop ring 238 can be locked with respect to the second hook 226 by way of a set screw, cam locking device, or other similar or dissimilar mechanism commonly recognized in the art.

Once the aforementioned depth of positioning the lock of the pusher hook 120, 220 is completed, retail merchandise can thereafter be loaded upon the first hook 124, 224. The pusher hook 120, 220 is then ready for use. Once the merchandise is depleted, it can simply be reloaded. In the event it is desirable to load different merchandise upon the pusher hook 120, 220, the above steps of adjusting the position of the stop can be repeated depending upon the particular type of merchandise incorporated.

As described herein, embodiments of the present invention reduce or eliminate the undesirable forward lean of retail merchandise associated with pusher hook type designs by incorporating a stop that limits the maximum forward-most point of travel of a pusher body of the pusher hook. By limiting such travel, there is a reduced amount of biasing force exerted upon a row of retail merchandise carried by the pusher hook so as to prevent the aforementioned forward lean.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pusher hook mountable on a retail merchandise wall and configured to carry and bias retail merchandise, the pusher hook comprising:

a first hook;

a second hook;

a pusher mechanism mounted on the second hook, the pusher mechanism operable to bias retail merchandise carried by the first hook forward and towards an end thereof;

a stop mounted on the second hook and spaced apart from an end thereof, the stop operable to limit the forward travel of a pusher body of the pusher mechanism mounted on the second hook;

wherein the stop is operable so as not to inhibit continued movement of the retail merchandise on the first hook beyond the stop, wherein the stop does not contact the retail merchandise when the retail merchandise is carried on the first hook;

wherein the stop is selectively adjustable with respect to its location along the second hook;

wherein a vertical height of the stop does not exceed twice the diameter of the second hook;

wherein the pusher body includes a pusher body connection portion comprising:

a pair of pusher body resilient tabs in opposed space relation with a gap formed therebetween, the second hook slideably received within the gap; and a pair of retaining tabs in opposed space relation with a retaining tab gap formed therebetween, a free end of a coil spring held between the retaining tabs;

wherein the pusher body resilient tabs are operable to permit a biasing force of a coil spring carried by the stop to slideably move the pusher body along the second hook; and wherein a free end of the coil spring remains held between the retaining tabs during a movement of the pusher body.

2. The pusher hook of claim 1, wherein the pusher mechanism is mounted on the second hook above the first hook and includes a housing spaced apart from the pusher body, the housing carrying the coil spring having an uncoiled portion extending from the housing with the free end thereof connected to the pusher body, wherein the stop is formed on the housing such that the pusher body abuts the stop away from the end of the second hook.

3. The pusher hook of claim 2, wherein the stop is formed by an abutment surface of a rear wall of the housing, and wherein the rear wall and a pair of opposed side walls define a chamber for receipt of a coiled portion of the coil spring.

4. The pusher hook of claim 3, wherein the pusher body includes a connector portion that slidably mounts the pusher body to the second hook, and wherein forward travel of the pusher body is limited by abutment of the connector portion with the abutment surface of the housing.

5. The pusher hook of claim 1, wherein the pusher mechanism is mounted on the second hook above the first hook and includes a housing spaced apart from the pusher body, the housing carrying the coil spring having an uncoiled portion extending from the housing with the free end thereof connected to the pusher body, wherein the stop is mounted on the second hook between the housing and the pusher body.

6. The pusher hook of claim 5, wherein the stop is a ring shaped collar and is slidable along the second hook relative to the pusher body and relative to the housing.

7. The pusher hook of claim 6, wherein the stop includes a lock for fixing a position of the stop along the second hook, the position defining a maximum forward point of travel of the pusher body.

8. The pusher hook of claim 1, wherein the pusher body is slidably mounted on the second hook, and wherein the first hook is below the second hook and is configured to carry merchandise thereon, the pusher body including a slot therethrough for passage of the first hook.

9. The pusher hook of claim 8, wherein the pusher mechanism includes a housing, the housing carrying the coil spring having an uncoiled portion with the free end, the free end connected to the pusher body, wherein retraction of the pusher body along the second hook and away from the housing uncoils the coil spring from the housing.

10. The pusher hook of claim 9, wherein the housing includes a connector portion, the connector portion providing for a resilient snap connection of the housing to the second hook.

11. The pusher hook of claim 10, wherein the connector portion includes a pair of resilient tabs in opposed spaced relation with a gap formed therebetween, the second hook received within the gap, wherein the gap is sized to substantially limit free sliding movement of the housing along the second hook.

12. The pusher hook of claim 11, wherein the connector portion includes a lock, the lock configured to fix the housing at a select location along the second hook.

13. A retail merchandise display for self facing retail merchandise, the retail merchandise display comprising:

a generally vertical retail wall;

a retail merchandise hook extending from the generally vertical retail wall, the retail merchandise hook including a first hook and a second hook;

a pusher mechanism having a limited stroke positioned on the retail merchandise hook; and a stop mounted on the second hook of the retail merchandise hook configured to limit the travel of a pusher body of the pusher mechanism along the first hook of the retail merchandise hook to less than the entire length of, the retail merchandise hook;

wherein the stop is operable so as not to inhibit continued movement of the retail merchandise on the first hook beyond the stop, wherein the stop does not contact the retail merchandise when the retail merchandise is carried on the first hook; wherein the stop is selectively adjustable with respect to its location along the second hook;

wherein a vertical height of the stop does not exceed twice the diameter of the second hook;

wherein the pusher body includes a pusher body connection portion comprising:

a pair of pusher body resilient tabs in opposed space relation with a gap formed therebetween, the second hook slideably received within the gap; and a pair of retaining tabs in opposed space relation with a retaining tab gap formed therebetween, a free end of a coil spring held between the retaining tabs;

wherein the pusher body resilient tabs are operable to permit a biasing force of a coil spring carried by the stop to slideably move the pusher body along the second hook; and wherein the free end of the coil spring remains held between the retaining tabs during a movement of the pusher body.

14. The retail merchandise display of claim 13, wherein the stop is operable to selectively define a limit of forward travel of the pusher body along the retail merchandise hook, the limit of forward travel spaced away from a leading end of the retail merchandise hook.

15. The retail merchandise display of claim 14, wherein the pusher mechanism includes a housing carrying the coil spring, the coil spring having an uncoiled portion extending away from the housing with a free end thereof mounted to the pusher body to bias the pusher body towards the housing along the retail merchandise hook.

16. The retail merchandise display of claim 15, wherein the stop is formed by an abutment surface of the housing, the abutment surface abutting the pusher body to limit the forward travel thereof.

17. The retail merchandise display of claim 15, wherein the stop is a ring shaped collar slidable on the retail merchandise hook and positioned between the housing and the pusher body, the stop slidable along the retail merchandise hook relative to the pusher body and relative to the housing.

18. The retail merchandise display of claim 14, wherein the stop prevents forward movement of the pusher body along the retail merchandise hook beyond a stopping point, the stopping point spaced away from a leading end of the retail merchandise hook by at least about one inch.

19. A method for installing a pusher hook on a generally vertical retail wall, the method comprising:

mounting a mounting structure of the pusher hook on the generally vertical retail wall such that the pusher hook extends therefrom in a cantilevered fashion, the pusher hook including a first hook and a second hook;

selectively adjusting a position of a stop of the pusher hook along a length of the pusher hook to define a forward-most point of travel of a pusher body of the pusher hook along the length of the pusher hook such that the stop does not inhibit continued movement of the retail merchandise on the first hook beyond the stop, wherein the stop does not contact the retail merchandise when the retail merchandise is carried on the first hook; and wherein a vertical height of the stop does not exceed twice the diameter of the second hook;

biasing the retail merchandise with the pusher body, wherein the pusher body has a pusher body connection portion comprising:

a pair of pusher body resilient tabs in opposed space relation with a gap formed therebetween, the second hook slideably received within the gap; and a pair of retaining tabs in opposed space relation with a retaining tab gap formed therebetween, a free end of a coil spring held between the retaining tabs;

wherein the pusher body resilient tabs are operable to permit a biasing force of a coil spring carried by the stop to slideably move the pusher body along the second hook; and wherein the free end of the coil spring remains held between the retaining tabs during a movement of the pusher body.

20. The method of claim 19, further comprising locking the stop in a position such that the forward-most point of travel is spaced apart from a leading end of the pusher hook.

* * * * *